US005584659A

United States Patent [19]

Schmidt

[11] Patent Number: 5,584,659

[45] Date of Patent: Dec. 17, 1996

[54] DEVICE FOR FIXING TURBINE BLADES AND FOR ELIMINATING ROTOR BALANCE ERRORS IN AXIALLY FLOW-THROUGH COMPRESSORS OR TURBINES OF GAS TURBINE DRIVES

[75] Inventor: Guenter Schmidt, Dachau, Germany

[73] Assignee: MTU Motoren- und Turbinen-Union Muenchen GmbH, Munich, Germany

[21] Appl. No.: 520,681

[22] Filed: Aug. 29, 1995

[30] Foreign Application Priority Data

Aug. 29, 1994 [DE] Germany ..... 44 30 636.9

[51] Int. Cl.[6] ..... F01D 5/32

[52] U.S. Cl. ..... 416/221; 416/144

[58] Field of Search ..... 416/219 R, 220 R, 416/221, 248, 500, 144, 145

[56] References Cited

U.S. PATENT DOCUMENTS

| | | | |
|---|---|---|---|
| 2,985,426 | 5/1961 | Hunter et al. | 416/219 R |
| 4,451,205 | 5/1984 | Honda et al. | 416/219 R |
| 5,100,292 | 3/1992 | Matula et al. | 416/221 |
| 5,425,621 | 6/1995 | Maar | 416/221 |

FOREIGN PATENT DOCUMENTS

| | | | |
|---|---|---|---|
| 0557093 | 5/1958 | Canada | 416/220 R |
| 4300773 | 11/1993 | Germany . | |
| 0643914 | 9/1950 | United Kingdom | 416/220 R |

*Primary Examiner*—Edward K. Look
*Assistant Examiner*—Christopher Verdier
*Attorney, Agent, or Firm*—Evenson, McKeown, Edwards & Lenahan, P.L.L.C.

[57] ABSTRACT

In the device, the turbine blades are anchored with blade feet, which are profiled like teeth, to correspondingly shaped axial grooves of a wheel disk. An axial gap is left between each blade foot end and the base of an axial groove, in which gap a securing element is disposed. The securing element can be bent on both ends, which protrude out from the gap, directed opposite each other against faces of the wheel disk and a blade foot, and is clamped in a wedged manner in the relevant axial gap between the groove base and the blade foot. The securing element bridges over a recess, which is formed in the blade foot to receive a balancing mass.

10 Claims, 1 Drawing Sheet

DEVICE FOR FIXING TURBINE BLADES AND FOR ELIMINATING ROTOR BALANCE ERRORS IN AXIALLY FLOW-THROUGH COMPRESSORS OR TURBINES OF GAS TURBINE DRIVES

BACKGROUND AND SUMMARY OF THE INVENTION

The present invention relates to a device for fixing turbine blades and for eliminating rotor balance errors in axially flow-through compressors or turbines of gas turbine drives. More particularly, the invention relates to a device in which the turbine blades are anchored with their blade feet, which are profiled like teeth, arranged in correspondingly shaped axial grooves of a wheel disk. An axial gap is left between a blade foot end and the base of an axial groove. A securing element is disposed in the gap, and the securing element is bent on both ends which protrude out from the gap, directed opposite each other, against the face ends of the wheel disk and a blade foot.

A fixing device of the above-described type is known from German Patent document DE-PS 4 300 773. In this case, the respective, simultaneous axial securing of the turbine blades and inserts occurs via a securing plate. The inserts are each axially fixed radially beneath the securing plate, in the axial gap between the foot end and groove base. An insert is required for each axial groove. If need be, one or more inserts can be changed as needed into one insert with a specifically adapted balancing mass.

In the known device, a certain amount of installation play is assumed between opposite support faces of the foot-groove gearings, by means of which problems arise in the elimination of rotor balance errors, in particular in combination with a radial, outer shroud bracing and support of the turbine blades. These problems in the installed rotor disk result from seat positions of the turbine blades, which positions differ on the circumference. The disk balance errors, which result from the blade seat positions, which are in different locations or cannot be precisely defined, cannot themselves be controlled by multiple and often time-consuming balancing procedures.

Rivet securing devices for the turbine blades on the rotor disk, which have already been proposed, are likewise afflicted with the above-mentioned problem. Furthermore, they have the disadvantage of high assembly and disassembly expenditures. In addition, there is a danger of local damage of the blade feet and of the wheel disk, in particular when releasing the rivetted joint. Rivetted joints of this kind are also often linked to structural changes, in particular in the wheel disk or the axial grooves, from which in turn problems can arise with regard to the component strength of the wheel disk, which is extremely heavily loaded on the radial outer circumference.

There is therefore needed a device which, when the blade securing is assembled, makes available a virtually play-free seat of the turbine blades on the wheel disk in a simple and easily assembled construction, and which at the same time makes it as easy as possible to eliminate possible disk or rotor balance errors.

These needs are met by a device for turbine blade fixing and for eliminating rotor balance errors in axially flow-through compressors or turbines of gas turbine drives, in which the turbine blades are anchored with their blade feet, which are profiled like teeth, arranged in correspondingly shaped axial grooves of a wheel disk. An axial gap is left between a blade foot end and the base of an axial groove. A securing element is disposed in the gap, and the securing element is bent on both ends which protrude out from the gap, directed opposite each other, against the face ends of the wheel disk and a blade foot. Each securing element is clamped like a wedge in an axial gap between the groove base and the blade foot and bridges over a recess, which is embodied in the blade foot to receive a balancing mass.

In accordance with the present invention, each turbine blade is pressed play-free with its foot side contact or support faces against the corresponding support faces of the axial groove in the relevant wheel ring of the wheel disk. All the turbine blades are disposed practically in a respectively uniform, static support and installation state so that if need be, a balance error or a residual balance error, or imbalance, still existing in the disk can be clearly defined and compensated for. As long as there is a disk balance error, the relevant specifically weight-adapted balancing masses are fixed in an operationally secure manner, opposite the securing element in the relevant recess on the blade foot. With comparatively simple assembling and disassembling possible, the turbine blades and the securing element are secured to the wheel disk in the axial direction.

The radial gap height, at least in the direction of a wheel ring or disk face end, can be dimensioned large enough so that the balancing mass can first be inserted via the one, larger lateral gap opening into the recess on the blade foot and the securing element is thereupon wedged onto it.

In principle, the wedge-like clamping can furthermore be carried out by forming the securing element in a partial wedge shape. An intensive and uniform surface pressure, which is as great as possible along the blade foot, can be achieved, according to which the axial gap and the securing element are essentially wedge-shaped and matched to each other with regard to the axially changing course of the gap height.

It is an advantage of the present invention that the wedge-shaped course can be obtained from the respective, unilateral foot slope relative to the axis-parallel end face of the groove base. Consequently, the axial groove, and hence the wheel disk, do not have to be changed structurally with regard to the realization of the invention.

It is a further advantage that the securing element can be made comparatively heavy in weight.

When the intrinsic weight of the securing element is specifically low, in particular by forming the element as a sheet metal bead, a comparatively simple producibility and simultaneously—required up to this point—an inherently stable construction is produced.

Good support and securing properties are produced with the securing element. A certain elastic deformation of the support sections can be allowed, in order to guarantee as axially uniform as possible a surface pressure prevailing on the blade foot, with regard to shape tolerances.

In principle, there is the possibility of compensating for preset component tolerances between the respective foot end and the base of an axial groove by means of a preset form choice of available securing elements.

Other objects, advantages and novel features of the present invention will become apparent from the following detailed description of the invention when considered in conjunction with the accompanying drawings.

DETAILED DESCRIPTION OF THE DRAWINGS

Figure 1:
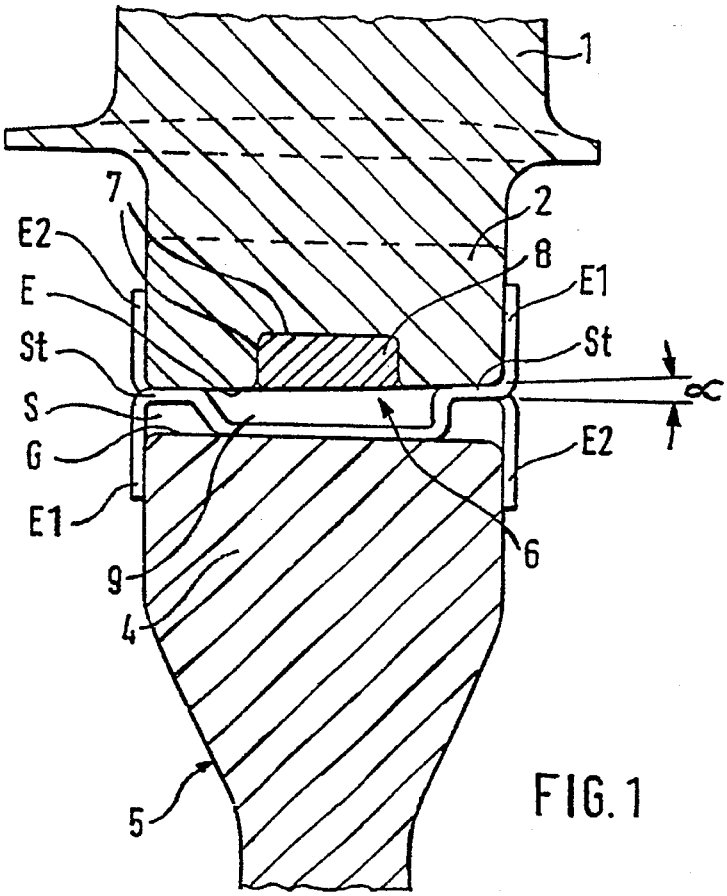
FIG. 1 is a cross-sectional view taken along the cutting line II—II of FIG. 2, showing an offset axial section of a wheel disk section, which view is incomplete radially on the inside and toward the blade on the outside, in order to explain a lateral view of the securing element in an axially and radially fixed disposition in the respective axial gap between the local foot end and the base of an axial groove of the wheel disk.
Figure 2:
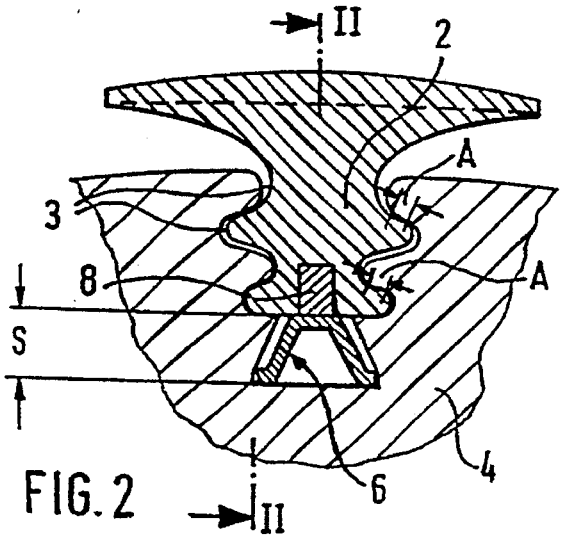
FIG. 2 is a cross-section view of the wheel disk according to FIG. 1 with a locally crosswise, central section through the blade foot, the relevant securing element, which is anchored to an axial groove, and a balancing weight in the local foot recess of the turbine blade; the axial gap is shown with locally greater structural height than in FIG. 1.

Referring to FIGS. 1 and 2, a turbine blade 1, with its multi-toothed blade foot 2, is anchored to a correspondingly formed axial groove 3 on the wheel ring 4 of a wheel disk 5. An axial gap S is formed between the radially inner end E of the blade foot 2 and the groove base G of the axial groove 3. With respect to the installation height, the axial gap S is formed so as to widen in an increasingly uniform manner in an approximate wedge shape as shown in FIG. 1, viewed from left to right. In the present case, the course of the axial gap S, which widens in a wedge-shape, is characterized for example by the inclination angle $\alpha$. The angle $\alpha$ is defined between the groove base G, which is parallel to the disk axis, and the radially interior end E of the blade foot 2 which is oblique to the groove base G. The oblique end E of the blade foot 2 can be achieved for example by means of an oblique cut.

A securing element 6, which is inserted via the right, open gap side of the axial groove 3, is clamped like a wedge inside the axial gap S. In this manner, the turbine blade 1 is fixed without any play in the axial groove 3. A firm support contact is provided along the opposite support position A (FIG. 2), between the foot and groove tooth profiles.

With a radial, outer wall section, the securing element 6 bridges over a recess 7. The recess 7 is contained in the blade foot 2 which is open on one side, and receives a specifically weight-adapted balancing mass 8.

According to FIGS. 1 and 2, the securing element 6 is made of a sheet metal strip. The sheet metal strip is at least intermittently deformed so as to have a wedge-shape. This securing element can, for example, be made by a punching or stamping process. This is especially applicable to the production of a sheet metal bead 9, which essentially supplies the required wedge shape, so that the axial gap S and the securing element 6 are embodied as essentially wedge-shaped and matched to each other with regard to the course of the gap height, which changes axially on one side.

In the example of FIGS. 1 and 2, the securing element 6, having laterally straight-walled sections, rests on the groove base G. Beginning at the straight-walled sections, the securing element 6 is deformed to make the sheet metal bead 9 such that—as shown in FIG. 2—a cross section is formed that compared to the groove base G is partially open on one side, is roughly trapezoidal, and is matched to the locally existing end contour of the axial groove 3 at the axial gap S.

According to FIG. 1, the securing element 6 can have support sections St on the end regions on both sides of the axial gap S. The support sections St, between which the sheet metal bead 9 extends, can be supplied by sheet metal sections, which are bent at an angle relative to the straight-walled sections. Furthermore, the securing element 6 includes dividing lines or gaps, which are open axially on the side, so that end pieces E1, E2, which protrude laterally outward in an axial direction from the support sections St, can be bent radially like tabs to axially secure the securing element 6 and the relevant turbine blade 1 via the blade foot 2 on the wheel disk 5.

Even without the support sections St, the invention can be carried out, namely in combination with the wedge-shaped bead 9 with the end pieces E1, E2, which can be bent like tabs.

Figure 3:
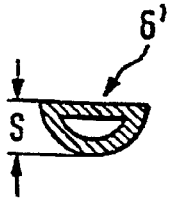
FIG. 3 shows a lateral and central section of a first embodiment of the securing element in accordance with FIG. 2.
Figure 4:
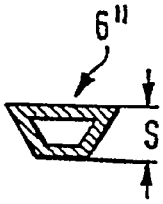
FIG. 4 shows a lateral and central section of a second embodiment of the securing element in accordance with FIG. 2.

In relation to the respective axial groove contour predetermined at the axial gap S, FIGS. 3 and 4 embody modified, hollow profile designs for securing elements 6' and 6". These profile designs are closed, for example, above the circumference. In FIG. 3, the securing element 6' has a rounded contour, which is matched to the radial, interior axial groove contour.

In FIG. 4, the closed, hollow profile contour of the securing element 6" is formed so that, viewed for example from top to bottom, it tapers down in a wedge shape matched to the radial, inner axial groove contour at the gap S.

In a modification of FIGS. 1–4, solid profiles, which can be made for example by a rolling, forging, or pressing process, can be used according to the invention for the securing elements at least to supply the respective wedge shape at the axial gap S.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A turbine blade fixing device for eliminating rotor balance errors in axially flow-through compressors or turbines of gas turbine drives, comprising:

at least one turbine blade having a blade foot with a toothed profile;

a wheel disk having axial grooves shaped to match said toothed profile of the blade foot, said turbine blade being anchored in one of said axial grooves;

an axial gap formed between an end of the blade foot and a base of the axial groove;

an elastically deformable securing element having support sections disposed in said gap, the securing element having ends protruding out from said gap and being bent opposite each other on each end against face ends of the wheel disk and the blade foot;

wherein a recess is formed in the blade foot for receiving a balancing mass; and wherein said securing element is clamped in a wedged manner in the axial gap allowing elastic deformation of the support sections between the base of the axial groove and the blade foot so as to bridge said recess.

2. A device according to claim 1, wherein the securing element is formed partially in a wedge shape, having a component cross-section, which continuously increases in an axial direction of said gap.

3. A device according to claim 1, wherein said axial gap has a wedge shape with an overall height between the end of the blade foot and the groove base, said end of the blade foot and the groove base being inclined relative toward one another, and said overall height continuously increasing in an axial direction of the gap.

4. A device according to claim 1, wherein the axial gap and the securing element are generally wedge-shaped so as to match each other with respect to a course of the gap height, said course changing axially on one-side of said gap.

5. A device according to claim 3, wherein a course of the wedge-shaped axial gap is formed between the groove base, which is parallel to the wheel disk axis, and the end of the blade foot, which end of the blade foot is oblique with respect to the groove base.

6. A device according to claim 1, wherein said securing element is formed of a sheet metal strip at least intermittently deformed to have a wedge-shape.

7. A device according to claim 6, wherein the securing element is formed with the wedge-shape via a sheet metal bead which straight-walled sections of the securing element extending in a direction of the end of the blade foot, and wherein the straight-walled sections of the securing element rest on the groove base.

8. A device according to claim 6, wherein said support sections are provided for the securing element on end regions on both sides of the axial gap, said support sections are bent at angles to match an installation height, which varies from location to location, and are adjoined by said ends of the securing element, said ends being bent like tabs via dividing gaps in said ends.

9. A device according to claim 7, wherein said support sections are provided for the securing element on end regions on both sides of the axial gap, said support sections are bent at angles to match an installation height, which varies from location to location, and are adjoined by said ends of the securing element, said ends being bent like tabs via dividing gaps in said ends.

10. A device according to claim 1, wherein with respect to a larger part of a longitudinal extension of the axial gap, the securing element is formed with one of a hollow and solid profile matched to a locally predetermined contour of the axial groove on the axial gap.

* * * * *